United States Patent [19]

Franck et al.

[11] Patent Number: 4,737,262

[45] Date of Patent: Apr. 12, 1988

[54] PROCESS FOR THE CATALYTIC REFORMING OF A CHARGE PASSING THROUGH AT LEAST TWO CATALYST BEDS

[75] Inventors: Jean-Pierre Franck, Bougival; Jean-Paul Bournonville, Cergy Pontoise, both of France

[73] Assignee: Institut Francais du Petrole, Rueil-Malmaison, France

[21] Appl. No.: 10,596

[22] Filed: Feb. 3, 1987

[30] Foreign Application Priority Data

Feb. 3, 1986 [FR] France ..... 86 01551

[51] Int. Cl.[4] ..... C01G 35/06

[52] U.S. Cl. ..... 208/65; 208/64

[58] Field of Search ..... 208/64, 65

[56] References Cited

U.S. PATENT DOCUMENTS 2,814,599 11/1957 Lefrancois et al. .
3,415,737 12/1968 Kluksdahl .
3,700,588 10/1972 Weisang et al. .
3,702,294 11/1972 Rausch .
3,772,183 11/1973 Bertolacini et al. .
3,903,195 9/1975 Franck et al. ..... 585/741
4,507,401 3/1985 Dubois et al. .
4,548,918 10/1985 Bournonville et al. .
4,588,495 5/1986 Franck et al. ..... 208/65

*Primary Examiner*—Curtis R. Davis
*Attorney, Agent, or Firm*—Millen & White

[57] ABSTRACT

A process for the catalytic reforming of a hydrocarbon charge wherein the charge passes successively through at least two catalyst beds, the first one being a bed of a first catalyst whose carrier contains platinum, rhenium and at least one halogen, at least the last bed being a moving bed of a second catalyst whose carrier contains platinum, at least one additional metal M selected from the group consisting of tin, gallium, germanium, indium, lead and thallium and at least one halogen, said metal M being introduced onto this carrier by means of an organometallic compound and the proportion by weight of said second catalyst being from 25 to 55% of the total catalyst mass used in all the catalyst beds. The charge preferably passes through at least two fixed beds of the first catalyst and at least one moving bed of the second catalyst, the carrier of the two catalysts being preferably alumina.

By this process high grade gasolines (of Research Octane Number higher than 95) are produced over long periods.

17 Claims, No Drawings

PROCESS FOR THE CATALYTIC REFORMING OF A CHARGE PASSING THROUGH AT LEAST TWO CATALYST BEDS

BACKGROUND OF THE INVENTION

Catalysts comprising an alumina carrier, a group VIII noble metal (usually platinum), and rhenium as additional metal promoter (U.S. Pat. No. 3,415,737) are known for their impact in the field of catalytic reforming or aromatic hydrocarbon production. Other catalysts are also known in this field which contain, in addition to a group VIII noble metal (usually platinum) a metal promoter consisting for example of tin, lead, indium, gallium or thallium (U.S. Pat. No. 3,700,588, U.S. Pat. No. 2,814,599).

From tests and after very long periods of use, for example of about one year, it appeared that a platinum-rhenium catalyst is very stable but does not give a maximum selectivity to high grade gasolines. Conversely, platinum-tin or platinum-indium or platinum-thallium catalysts provide for an excellent selectivity but these catalysts suffer from poor stability.

Hence, it seemed advisable to use catalysts containing, in addition to platinum, both promoters simultaneously, e.g. rhenium and tin (U.S. Pat. No. 3,702,294) or rhenium and indium. But it appeared that the selectivity of this type of catalyst was lower than that obtained with a platinum-tin or platinum-indium or platinum-thallium catalyst and also that the stability of this catalyst was less than that of the platinum-rhenium catalyst.

SUMMARY OF THE INVENTION

The invention concerns an improved catalytic hydrocarbon reforming process whereby gasolines of high grade are obtained over long periods (hence with a good stability) and with a satisfactory selectivity.

This process consists of contacting a flow of hydrocarbons, in reforming conditions, successively with a first and a second catalyst and of recovering the resultant reforming product; in this process the first catalyst, arranged in fixed or moving bed, comprises: (a) a carrier, (b) at least one noble metal of the platinum family, at least one of said noble metals being platinum, (c) rhenium and (d) at least one halogen, and the second catalyst, different from the first one and used in at least one moving bed, contains: (a) a carrier, (b) at least one noble metal of the platinum family, at least one of these noble metals being platinum, (c) at least one additional metal M selected from the group consisting of tin, gallium, germanium, indium, lead and thallium and (d) at least one halogen, said metal M being introduced in the carrier by means of a solution in an organic solvent of at least one organic compound selected from the group consisting of hydrocarbylmetals, halogenohydrocarbylmetals and polyketonic complexes of said metal M, and the proportion by weight of said second catalyst being generally from 25 to 55% of the total catalyst mass.

In an advantageous embodiment of the invention, the hydrocarbon charge will pass successively through at least two separate beds of said first catalyst, the total of all these beds of first catalyst amounting to 45–75% by weight of the total catalyst mass used in all the catalyst beds. Thus, in a preferred embodiment of the invention, the charge passes successively through two separate beds of said first catalyst, the first bed containing a catalyst mass amounting to about ⅓ of the total catalyst mass of said first catalyst, i.e. about 15–25% by weight of the total catalyst mass used for all the catalyst beds.

Generally the arrangement according to the invention, wherein the first catalyst operates at low severity (Research Octane Number (RON) of the product obtained at the output of the first bed and preferably of the first two beds ranging from 85 to 95 and more particularly from 87 to 92) and wherein the second catalyst is placed in a reactor with continuous catalyst generation, operating at high severity, gives a final reformate with with a high RON, generally higher than 95 and usually higher than 98.

All the reactors preferably operate at low pressure so as to take advantage of the yield gains resulting from the use of a low operating pressure.

The pressure is generally from 0.5 to 2.5 MPa, more advantageously from 0.7 to 1.2 MPa.

The first catalyst used in the first bed, preferably in the two first beds wherethrough passes the charge, contains:

(a) a carrier usually selected from oxides of metals from groups II, III and/or IV of the periodic classification of elements, such or example as magnesium, aluminum, titanium, zirconium, thorium or silicium oxides, taken alone or admixed with one another or with oxides of other elements of the periodic classification such for example as boron. Carbon may also be used. Also zeolites or molecular sieves of X or Y type, of the mordenite, faujasite or ZSM-5, ZSM-4, ZSM-8 etc. type can also be used as well as oxides of groups II, III and/or IV metals admixed with zeolite material.

(b) Generally from 0.01 to 2% by weight, in proportion to the carrier, of at least one noble metal of the platinum family, platinum being always present, preferably a proportion from 0.05 to 0.8% and more particularly from 0.1 to 0.6% by weight.

(c) Usually from 0.005 to 3% by weight of rhenium, in proportion to the carrier, preferably from 0.05 to 2% and more particularly from 0.1 to 0.6% by weight.

(d) Usually from 0.1 to 15% by weight of at least one halogen, in proportion to the carrier, preferably 0.5 to 3% and more particularly 0.9 to 2.5% by weight.

The second catalyst, used in at least the last catalyst bed wherethrough passes the charge, contains:

(a) A carrier identical to or different from that of the first catalyst, usually selected from the carriers mentioned above for the first catalyst, (b) Advantageously from 0.01 to 2% by weight, in proportion to the carrier, of at least one noble metal of the platinum family, platinum being always present, preferably in an amount from 0.05 to 0.8% and more particularly from 0.1 to 0.6% by weight, (c) Advantageously from 0.05 to 3% by weight of at least one additional metal or promoter M, preferably 0.07 to 2% and more particularly 0.1 to 0.6%, (d) Usually from 0.1 to 15% by weight, with respect to the carrier, of at least one halogen, preferably 0.5 to 3% and more particularly 0.9 to 2.5% by weight. The proportion by weight of the second catalyst is usually from 25 to 55% and preferably from 40 to 55% of the total catalyst mass used in all the catalyst beds.

The first catalyst then represents 45 to 75% by weight and preferably 45 to 60% by weight of the total catalyst mass used in all the catalyst beds. This first catalyst is preferably divided among at least two separate beds, the first bed representing usually about 15 to 25% by weight and preferably about 15 to 20% of the total catalyst mass used in all the catalyst beds and the second bed usually representing, in proportion to the same total mass, about 30 to 50% by weight and preferably about 30 to 40% by weight.

Reforming reactions are well known in the art as being highly endothermic; hence it will be preferable to operate in adiabatic reactors with a reheating between successive reactors or between successive catalyst beds wherethrough passes the charge. It will be preferred in particular to use at least two separate beds of the first platinum and rhenium-containing catalyst and to heat the charge before passing it over the second bed of said first catalyst.

By way of example, one of the following arrangements can be used:

two reactors in series, the first reactor containing two fixed beds of the first platinum and rhenium-containing catalyst, the second reactor, with continuous regeneration of the catalyst, comprising a moving bed of the second catalyst containing platinum and at least one additional metal M, three reactors in series, the two first with fixed beds, placed side by side or superposed, each containing one or more fixed beds of the first platinum and rhenium-containing catalyst and the third reactor, with continuous catalyst regeneration, comprising a moving bed of the second catalyst, containing platinum and at least one additional metal M.

The various arrangements of catalyst beds known in the art can be used, one of the essential features being that the hydrocarbon charge passes through one bed and preferably through at least two successive beds of the first platinum and rhenium-containing catalyst. The first bed wherethrough passes the charge will very advantageously consist of a fixed bed of the first catalyst containing platinum and rhenium and more preferably the two first beds will be fixed beds.

In reforming or aromatic hydrocarbon production it is usually preferred to use alumina as the catalyst carrier. Any type of alumina can be used but generally cubic gamma or eta alumina or a mixture thereof are convenient. In a preferred embodiment the same carrier is used for the first and for the second catalyst and the alumina is of the cubic gamma type.

The second catalyst used according to the present invention will advantageously contain, in addition to platinum, another noble metal from group VIII and preferably iridium. The iridium amount will be advantageously smaller than 0.5% by weight with respect to the carrier and generally from 0.005 to 0.3%.

In the catalytic zones other than that or those where the first platinum and rhenium-containing catalyst is present, a second supported catalyst will be advantageously used. This second catalyst contains, in addition to a halogen, the following metal combinations: platinum-tin, platinum-gallium, platinum-germanium, platinum-indium, platinum-lead, platinum-thallium, platinum-indium-tin, platinum-iridium-germanium, platinum-iridium-indium, platinum-iridium-lead, platinum-iridium-tin.

Preferred catalysts are those containing the associations: platinum-tin, platinum-indium, platinum-germanium, platinum-lead and platinum-iridium-indium. More preferred associations are platinum-tin, platinum-indium and platinum-iridium-indium.

In fact, in reforming reactions, the insufficient selectivity generally results in a poor yield of naphthene dehydrogenation to aromatic hydrocarbons and in a parasitic cracking of paraffins with secondary formation of olefinic hydrocarbons responsible for the coke formation. The present process provides for a maximum dehydrogenation of naphthenic hydrocarbons to aromatic hydrocarbons, a minimum cracking of paraffins, thus avoiding the formation of light hydrocarbons and resulting on the contrary in a maximum conversion of paraffins to aromatic hydrocarbons. Thus in the one or preferably the two first reaction beds using a catalyst of excellent stability, the essential operation is the hydrocarbon dehydrogenation, particularly that of naphthenes to aromatic hydrocarbons and, in the last reaction zone, in view of the selectivity achieved by the proper selection of the catalyst, reactions of paraffin cyclization without cracking thereof are also achieved.

Catalytic reforming catalysts used according to the invention are generally prepared according to conventional methods consisting of impregnating the carrier with solutions of the metal compounds to introduce, either as a common solution of said metals or a separate solution for each metal.

When several solutions are used, intermediate drying or roasting steps may be advisable. Usually the final operation is a roasting, for example between about 450° and 1000° C., preferably in the presence of free oxygen, for example with air scavenging.

Platinum (and optionally another noble metal of the platinum family) may be introduced into the carrier by impregnating the latter with an aqueous or non-aqueous suitable solution containing a salt or compound of noble metal.

Platinum is generally introduced into the carrier as chloroplatinic acid or as organic compound of platinum, particularly as polyketonic complexes of platinum, for example platinum acetylacetonate, halogenopolyketonic complexes of platinum, platinum amminated complexes, platinum halogenoamminated complexes and salts of said compounds. In particular, platinum organic compounds can be used to introduce this metal on the carrier of the second catalyst.

Rhenium may be introduced into the carrier by impregnation thereof with at least one adequate aqueous solution containing a rhenium salt or compound. The two preferred precursors are ammonium perrhenate and perrhenic acid.

The halogen of the catalyst may originate from one of the metal halides when at least one of the metals is introduced as halide, or it may be introduced as halohydric acid, ammonium halide, halogen gas or halogenated organic compounds. The halogen will be preferably chlorine or fluorine. Examples of compounds which can be used to introduce halogen are hydrochloric acid, hydrofluoric acid, ammonium chloride and fluoride, chlorine gas, halogenated hydrocarbons such as carbon tetrachloride, chloroform, dichloromethane, 1,2-dichloroethane, and 1,1 dichloroethane.

The additional metal or promoter M is introduced in the carrier of the second catalyst by means of a solution in an organic solvent of an organic compound of said metal selected from the group consisting of hydrocarbylmetals, halogenohydrocarbylmetals and polyketonic complexes of metals.

Specific examples of metal organic compounds are metal alkyl, cycloalkyl, aryl, alkylaryl, and arylalkyl of metals M and acetylacetonates of metals M.

Organohalogen compounds of metals M may also be used.

Preferred compounds are: tetrabutyltin, tetramethyltin, diphenyltin, triethylgallium, gallium acetylacetonate, trimethylindium, indium acetylacetonate, tetrapropylgermanium, diphenylgermanium, tetraethyllead, tetraphenyllead, tetraethylthallium, cyclopentadienylthallium.

The impregnation solvent is usually selected from the group consisting of paraffinic, naphthenic or aromatic hydrocarbons containing 6 to 12 carbon atoms per molecule and halogenated hydrocarbons having 1 to 12 carbon atoms per molecule.

Examples of organic solvents are n-heptane, methylcyclohexane, toluene and chloroform. Mixtures of the above-defined solvents may also be used.

Thus, it has been discovered that, by using a second catalyst in a moving bed at least for the last catalyst bed, when the additional metal M and optionally the noble metal of the platinum family have been introduced by means of an organic compound, it is possible to operate the unit over long periods with an increased selectivity as compared with the achievements of the prior art. By using a second catalyst at least the additional metal M of which has been introduced by means of an organic compound, it is possible to reduce the proportion of said second catalyst with respect to the whole catalyst mass of the unit, this reduction being a significant advantage inasmuch as it concerns the catalyst of lower stability.

The catalysts used according to the present invention are preferably subjected, at the end of their preparation, to a roasting at about 450°–1000° C. and may be advantageously subjected before their use, prior to their introduction in the reactors or in situ, to an activation treatment under hydrogen at high temperature, for example about 300°–500° C. This treatment under hydrogen is performed for example by slowly increasing the temperature, under a hydrogen stream, up to the selected maximum temperature, for example from 300° to about 500° C. and preferably from about 350° to 480° C., and then maintaining said temperature for about 1 to about 6 hours.

It is also possible, according to a preferred mode of preparation of said second catalyst, to introduce on the carrier at least one noble metal of the platinum family, at least one of said noble metals being platinum, to subject it to a roasting and optionally to a reduction with hydrogen as above indicated, then to introduce one or more metals and particularly the additional metal M when the second catalyst is concerned, with eventually, at the end of the introduction of the one or more other metals, a roasting and an optional reduction of the obtained catalyst.

A preferred method for preparing said first platinum and rhenium-containing catalyst comprises the steps of:

(a) impregnating the carrier with an acid solution containing at least one halogen, at least one platinum compound and at least one rhenium compound, (b) drying the resultant catalyst mass, (c) roasting and then optionally reducing the obtained catalyst mass.

The acid solution used in step (a) will advantageously contain hydrochloric acid, chloroplatinic acid and perrhenic acid.

A first preferred method of preparation of said second catalyst containing platinum and at least one additional metal M, comprises the steps of:

(a) impregnating the carrier with an acid solution containing at least one halogen and containing platinum and optionally at least one other noble metal of the platinum family, (b) drying the resultant catalyst mass, (c) roasting and then optionally reducing the resultant catalyst mass, (d) contacting said mass with a hydrocarbon solvent and with said organic compound of additional metal M, for example by immersing the mass in a solvent, for example a hydrocarbon solvent, and then introducing in the resultant mixture a solution of the organic compound in a solvent, for example a hydrocarbon solvent and particularly the solvent wherein said mass was immersed, (e) removing the solvent and drying the catalyst mass, (f) roasting and then optionally reducing the resultant catalyst mass before contacting it with the hydrocarbon charge and hydrogen.

A second preferred method of preparation of said second catalyst containing platinum and at least one additional metal M, when the noble metal of the platinum family is introduced by means of an organic compound, comprises the steps of:

(a) impregnating the carrier with a solution containing at least one platinum organic compound and optionally at least one organic compound of another noble metal of the platinum family, (b) drying the resultant catalyst mass, (c) roasting the obtained dry catalyst mass in the presence of halogenated organic compound so as to fix the desired halogen amount on the carrier and then optionally reducing the resultant catalyst mass, (d) contacting said mass with a hydrocarbon solvent and with the organic compound of said additional metal M, for example by immersing the mass in a solvent, for example a hydrocarbon solvent, and then introducing in the resultant mixture a solution of the organic compound in a solvent, for example a hydrocarbon solvent such for example as the solvent wherein the mass was immersed, (e) removing the solvent and drying the catalyst mass, (f) roasting and then optionally reducing the obtained catalyst mass before contacting it with the hydrocarbon charge and hydrogen.

The reforming operations start by adjusting the hydrogen and charge feed rates as well the temperature and pressure within the operational conditions. The general reforming conditions are well-known in the art, usually catalytic reforming is performed at a temperature from 400° to 600° C. under an absolute pressure from 0.1 to 3.5 MPa, at a hourly space velocity (VVH) from 0.1 to 10 volumes of charge per volume of catalyst and per hour and with a hydrogen/hydrocarbons ($H_2$/HC) molar ratio from 1:1 to 20:1.

The preferred conditions are: temperature from 460° to 580° C., pressure from 0.5 to 2.5 MPa and more advantageously from 0.7 to 1.2 MPa, VVH from 1 to 10 and more advantageously from 1 to 6 and $H_2$/HC ratio from 2:1 to 10:1. The hydrocarbon charge is usually a naphtha distilling from about 60° C. to about 220° C., particularly a straight-run naphtha.

EXAMPLES

The following examples are given to illustrate the invention but must not be considered as limiting the scope thereof:

Example 1

The charge has the following characteristics:

Density at 15° C.: 0.741

ASTM distillation: (°C.)

IP: 90

50%: 118

90%: 148

FP: 159

Composition (% by weight):

paraffinic hydrocarbons: 58.9 naphthenic hydrocarbons: 28.4 aromatic hydrocarbons: 12.7

This charge is treated, in the presence of hydrogen, under operating conditions representative of a typical mode of operation for maximizing the $C_5+$ gasoline yield and the hydrogen production and for obtaining a reformate whose Research Octane Number is 98. These operating conditions are the following:

Total pressure (bar): 10 (1 MPa)

Hydrogen/hydrocarbon ratio (mole/mole): 3

Volume space velocity (VVH): 3 times the total catalyst volume.

The charge flows successively through 3 reactors in series. Each of the two first reactors contains a fixed bed of catalyst A and the third reactor, operating with continuous catalyst regeneration, contains a moving bed of B type catalyst.

Catalyst A represents 50% by weight of the total catalyst amount used in the three reactors (catalyst B hence amounting to 50% by weight of the total catalyst mass).

Catalyst A contains 0.4% platinum and 0.4% rhenium by weight in proportion to the catalyst carrier which consists of an alumina whose specific surface is 240 $m^2.g^{-1}$ and whose pore volume is 0.57 $cm^3.g^{-1}$. Catalyst A further contains 1.15% of chlorine. The specific surface and the pore volume of catalyst A are respectively 235 $m^2.g^{-1}$ and 0.55 $cm^3.g^{-1}$.

The Catalyst of B type has the same carrier as catalyst A and contains by weight:

0.4% of platinum 0.1% of tin 1.15% of chlorine.

Two catalysts of B type are prepared, the first, called $B_1$ (catalyst not conforming with the invention, for comparison purpose), wherein tin is introduced from tin chloride and the second, called $B_2$, wherein tin is introduced in conformity with the invention from tetrabutyltin dissolved in n-heptane.

Table 1 hereinafter gives the respective performances of the catalyst arrangement A in the two first reactors and of $B_1$ in the third reactor and of the catalyst arrangement A in the two first reactors and $B_2$ in the third reactor:

The operation is conducted for 300 hours for the arrangement catalyst A–catalyst $B_1$. Catalyst A is not regenerated. Catalyst $B_1$, used as moving bed, is continuously withdrawn from the reactor at a rate so calculated as to withdraw it completely, to regenerate and reintroduce it continuously in the third reactor in 300 hours. It is assumed that, in this operation, the catalyst association A–$B_1$, used as reference, has for 300 hours a relative stability equal to 1 and a regeneration frequency equal to 1. The considered stability criterium is the time after which the $C_5+$ yield, expressed in percent by weight of the charge, is decreased by 2% with respect to its initial value.

From the comparison of the results it clearly appears that the use of catalyst $B_2$ in the third reactor (in place of catalyst $B_1$) provides for a better selectivity and a better stability.

In particular it is observed that the association of A and $B_2$ catalysts gives a yield (87.5%) and a hydrogen production (3.05) higher than the association of catalysts A and $B_1$, after a time of experimentation of catalysts A and $B_2$ substantially longer than that of catalysts A and $B_1$: a relative stability of 1.3 means that the operation was extended over $1.3\times300$ hours $=390$ hours and, after these 390 hours, only $0.7\times100=70\%$ of catalyst $B_2$ had to be regenerated.

TABLE 1

| | CATALYST A + CATALYST $B_1$ | CATALYST A + CATALYST $B_2$ |
|---|---|---|
| Temperature | 480° C. | 480° C. |
| $C_5+$ yield (% by weight) | 86.2 | 87.5 |
| $H_2$ production (% by weight) | 2.88 | 3.05 |
| Relative stability | 1 | 1.30 |
| Regeneration frequency | 1 | 0.70 |

Example 2

(comparative)

Example 1 is repeated (association of catalyst A with catalyst $B_2$) but catalyst A only represents 20% by weight of the total catalyst amount used in the three reactors (catalyst $B_2$ thus amounting to 80% by weight of the total catalyst mass). Catalyst A is charged in fixed bed in the first reactor and catalyst $B_2$ is distributed among the next two reactors operating with continuous catalyst regeneration, each reactor containing a moving bed of catalyst $B_2$.

The operating performances obtained with said arrangement are the following:

$C_5+$ yield (% by weight): 87.7

$H_2$ production (% by weight): 3.07

Relative stability (reference 1 for A–$B_1$ association): 0.85 (i.e. about 255 hours of operation)

Regeneration frequency: 1.15

The comparison of these results with those obtained in example 1 for A and $B_2$ catalyst arrangement shows a very substantial decrease of the relative stability in spite of a selectivity slightly higher with, in addition, the requirement of more frequent regeneration.

Example 3

(comparative)

Example 1 (association of catalyst A and $B_2$) is repeated but the third reactor is charged with a fixed bed of catalyst $B_2$. The test is continued as long as the loss of $C_5+$ yield does not exceed 2% of its initial value. Accordingly, the test was discontinued after 180 hours of operation.

The performances of this arrangement are then:

$C_5+$ yield (% by weight): 87.4

$H_2$ production (% by weight): 3.04

Relative stability: 0.60 (180 hours).

Example 4

Example 1 is repeated but with catalysts $B_1$ and $B_2$ respectively replacing catalysts $C_1$ and $C_2$ and with catalysts $D_1$ and $D_2$ containing the same carrier and having the compositions specified in Table 2 hereinafter.

Table 3 below reports the performances obtained with asssociations of catalyst A respectively with catalysts $C_1$, $C_2$, $D_1$ and $D_2$.

The results show that the introduction of germanium (catalysts $C_1$, $C_2$) or lead (catalysts $D_1$, $D_2$) by means of an organometallic compound of the metal (catalysts $C_2$ and $D_2$) provides for a substantial improvement of the selectivity and of the stability as compared with those achieved when using in the third reactor catalysts wherein germanium and lead have been introduced by means of inorganic compounds (catalysts $C_1$ and $D_1$).

Moreover the comparison of the results obtained in example 1 with those obtained in the present example shows a slight superiority of the process when the catalyst of the third reactor contains platinum and tin as compared with a catalyst containing platinum and germanium or platinum and lead.

TABLE 2

| CATALYST | Pt % by weight | Cl % by weight | ADDITIONAL METAL Precursor | ADDITIONAL METAL % by weight |
|---|---|---|---|---|
| $C_1$ | 0.4 | 1.15 | $GeCl_4$ | 0.1 |
| $C_2$ | 0.4 | 1.15 | $Ge(Bu)_4$ | 0.1 |
| $D_1$ | 0.4 | 1.15 | $Pb(NO_3)_2$ | 0.1 |
| $D_2$ | 0.4 | 1.15 | $Pb(Et)_4$ | 0.1 |

TABLE 3

| | CATALYST A + CATALYST $C_1$ | CATALYST A + CATALYST $C_2$ | CATALYST A + CATALYST $D_1$ | CATALYST A + CATALYST $D_2$ |
|---|---|---|---|---|
| $C_5^+$ yield % by weight | 85.9 | 87.1 | 85.7 | 87.0 |
| $H_2$ production % by weight | 2.81 | 2.99 | 2.79 | 2.98 |
| Relative stability | 1 | 1.30 | 1 | 1.28 |
| Regeneration frequency | 1 | 0.68 | 1 | 0.72 |

Example 5

The operation is conducted in the same conditions as in example 1 with catalysts $E_1$ and $E_2$ having the same alumina carrier as catalyst $B_1$ and $B_2$ and containing:

0.4% by weight of platinum, 0.1% by weight of indium, 1.15% by weight of chlorine.

Catalyst $E_1$ is prepared from indium nitrate and catalyst $E_2$ from indium acetylacetonate.

The results are summarized in Table 4 hereinafter.

TABLE 4

| | CATALYST A + CATALYST $E_1$ | CATALYST A + CATALYST $E_2$ |
|---|---|---|
| $C_5^+$ yield (% by weight) | 86.0 | 87.0 |
| $H_2$ production (% by weight | 2.80 | 2.98 |
| Relative stability | 1 | 1.30 |
| Regeneration frequency | 1 | 0.70 |

The use in the third reactor of a catalyst wherein indium was introduced by means of an organometallic compound thus provides for a better activity and a higher selectivity than those obtained when using in the third reactor a catalyst wherein indium was introduced by means of an inorganic compound.

What is claimed as the invention is:

1. A catalytic reforming process wherein a flow of hydrocarbon charge is contacted, in reforming conditions, successively with a first catalyst and with a second catalyst and the reforming product is then recovered, characterized in that the first catalyst, used as fixed or moving bed, comprises (a) a carrier, (b) at least one noble metal of the platinum family, at least one of said noble metals being platinum, (c) rhenium and (d) at least one halogen, and in that the second catalyst, different from the first catalyst and used in at least one moving bed, contains (a) a carrier, (b) at least one noble metal of the platinum family, at least one of said noble metals being platinum, (c) at least one additional metal M selected from the group consisting of tin, gallium, germanium, indium, lead and thallium and (d) at least one halogen, said metal M being introduced onto the carrier by means of a solution in an organic solvent of at least one organic compound selected from the group consisting of hydrocarbylmetals, halogeno-hydrocarbylmetals and polyketonic complexes of said metal M, the proportion by weight of said second catalyst ranging from 25 to 55% of the total catalyst mass.

2. A process according to claim 1, wherein the first bed wherethrough passes the hydrocarbon charge is a fixed bed.

3. A process according to claim 1, wherein the charge passes successively through at least two separate beds of said first catalyst.

4. A process according to claim 1, wherein the second catalyst contains platinum, iridium and at least one additional metal M.

5. A process according to claim 1, wherein the second catalyst is obtained by introducing platinum onto the carrier by means of at least one platinum organic compound.

6. A process according to claim 1, wherein the additional metal M of the second catalyst is selected from the group consisting of tin, indium, germanium and lead.

7. A process according to claim 1, wherein the additional metal M of the second catalyst is selected from the group consisting of tin and indium.

8. A process according to claim 1, wherein the first catalyst contains, in proportion by weight to the carrier, from 0.01 to 2% of at least one noble metal of the platinum family, from 0.005 to 3% of rhenium and from 0.1 to 15% of at least one halogen.

9. A process according to claim 1, wherein the second catalyst contains, in proportion by weight of the carrier, from 0.01 to 2% of at least one noble metal of the platinum family, from 0.005 to 3% of at least one additional metal M and from 0.1 to 15% of at least one halogen.

10. A process according to claim 1, wherein the carrier of the first and of the second catalyst essentially comprises alumina.

11. A process according to claim 1, wherein the carrier for the first catalyst is (i) an oxide of magnesium, aluminum, titanium, zirconium, thorium, boron or silicon, (ii) an X- or Y-zeolite, (iii) an X- or Y-zeolite admixed with a group II, III or IV metal, or (iv) carbon.

12. A process according to claim 3, wherein the first catalyst in the first bed is 15 to 25% by weight and the first catalyst in the second bed is 30 to 50% by weight of the total catalyst mass used in all of the catalyst beds.

13. A process according to claim 1, wherein the polyketonic complex of metal M is platinum acetylacetonate.

14. A process according to claim 1, wherein the first catalyst is prepared by a process comprising:

(a) impregnating the carrier with an acid solution containing at least one halogen, at least one platinum compound and at least one rhenium compound, (b) drying the resultant catalyst mass, (c) roasting and then reducing the obtained catalyst mass.

15. A process according to claim 14, wherein the acid solution in step (a) contains hydrochloric acid, chloroplatinic acid and perrhenic acid.

16. A process according to claim 1, wherein the second catalyst is prepared by a process comprising:

(a) impregnating the carrier with an acid solution containing at least one halogen, at least one platinum compound and at least one rhenium compound, (b) drying the resultant catalyst mass, (c) roasting and then reducing the obtained catalyst mass, (d) contacting said mass with a hydrocarbon solvent and with said organic compound of additional metal M, by immersing the mass in the hydrocarbon solvent, and then introducing in the resultant mixture a solution of the organic compound in a hydrocarbon solvent, (e) removing the solvent and drying the catalyst mass.

17. A process as to claim 16, wherein step (c) the dried catalyst mass is roasted in the presence of a halogenated organic compound.

* * * * *